US009764341B2

(12) United States Patent
Dau et al.

(10) Patent No.: US 9,764,341 B2
(45) Date of Patent: Sep. 19, 2017

(54) ELECTROSTATIC ATOMIZER

(71) Applicant: SUMITOMO CHEMICAL COMPANY, LIMITED, Tokyo (JP)

(72) Inventors: Van Thanh Dau, Takarazuka (JP); Tibor Terebessy, Wallingford (GB)

(73) Assignee: SUMITOMO CHEMICAL COMPANY, LIMITED, Tokyo (JP)

( * ) Notice: Subject to any disclaimer, the term of this patent is extended or adjusted under 35 U.S.C. 154(b) by 12 days.

(21) Appl. No.: 14/760,420

(22) PCT Filed: Jan. 15, 2014

(86) PCT No.: PCT/JP2014/050552

§ 371 (c)(1),
(2) Date: Jul. 10, 2015

(87) PCT Pub. No.: WO2014/112515

PCT Pub. Date: Jul. 24, 2014

(65) Prior Publication Data

US 2015/0336119 A1 Nov. 26, 2015

(30) Foreign Application Priority Data

Jan. 15, 2013 (JP) ..... 2013-004945

(51) Int. Cl.
*B05B 5/057* (2006.01)
*B05B 5/053* (2006.01)
(Continued)

(52) U.S. Cl.
CPC ..... *B05B 5/0533* (2013.01); *B05B 5/0255* (2013.01); *B05B 5/057* (2013.01); *B05B 5/0536* (2013.01); *B05B 5/08* (2013.01)

(58) Field of Classification Search
CPC ..... H02N 3/00; B05B 5/1691; B05B 5/0255; B05B 5/00; B05B 5/0533; B05B 5/0536; B05B 5/057; B05B 5/08; F03D 1/00
(Continued)

(56) References Cited

U.S. PATENT DOCUMENTS 4,196,437 A * 4/1980 Hertz ..... G01D 15/18 118/325
5,477,249 A * 12/1995 Hotomi ..... B41J 2/06 347/103
(Continued)

FOREIGN PATENT DOCUMENTS

CN 1898027 A 1/2007
EP 0 195 546 A2 9/1986
(Continued)

OTHER PUBLICATIONS

Translation of the International Preliminary Report on Patentability, dated Jul. 30, 2015 and the Written Opinion, dated Apr. 28, 2014 for corresponding Application No. PCT/JP2014/050552.
(Continued)

*Primary Examiner* — Chee-Chong Lee
(74) *Attorney, Agent, or Firm* — Foley & Lardner LLP

(57) ABSTRACT

An electrostatic atomizer (100) includes: a spray electrode (1); a reference electrode (2); a current control section (24) for controlling a value of a current flowing through the reference electrode (2); and a voltage application section (22) for applying a voltage across the spray electrode (1) and the reference electrode (2), based on the value of the current controlled by the current control section (24), the reference electrode (2) having a tip whose shape has a specific curvature radius.

3 Claims, 8 Drawing Sheets

(51) Int. Cl.
*B05B 5/08* (2006.01)
*B05B 5/025* (2006.01)

(58) Field of Classification Search
USPC ..... 239/690
See application file for complete search history.

(56) References Cited

U.S. PATENT DOCUMENTS

| | | | | |
|---|---|---|---|---|
| 6,264,298 | B1 * | 7/2001 | Mantell | B41J 2/2128 347/15 |
| 7,337,993 | B2 | 3/2008 | Pirrie | |
| 7,983,016 | B2 | 7/2011 | Akisada et al. | |
| 8,870,103 | B2 | 10/2014 | Pirrie | |
| 2002/0005876 | A1 * | 1/2002 | Grimes | B41J 2/09 347/53 |
| 2003/0025744 | A1 * | 2/2003 | Nou | B41J 2/0458 347/10 |
| 2003/0085940 | A1 * | 5/2003 | Yamada | B41J 29/393 347/19 |
| 2004/0251326 | A1 | 12/2004 | Pirrie | |
| 2007/0101934 | A1 * | 5/2007 | Nishio | B05B 5/0255 118/629 |
| 2007/0119993 | A1 | 5/2007 | Yamaguchi et al. | |
| 2008/0283636 | A1 | 11/2008 | Pirrie | |
| 2008/0314109 | A1 | 12/2008 | Shimoda et al. | |
| 2009/0109594 | A1 | 4/2009 | Akisada et al. | |
| 2010/0258649 | A1 | 10/2010 | Pirrie | |
| 2013/0270371 | A1 | 10/2013 | Pirrie | |
| 2014/0151471 | A1 | 6/2014 | Dau et al. | |

FOREIGN PATENT DOCUMENTS

| | | | |
|---|---|---|---|
| EP | 0 734 777 | A2 | 10/1996 |
| EP | 1 610 901 | A2 | 1/2006 |
| JP | 2004-530552 | A | 10/2004 |
| JP | 2006-521915 | A | 9/2006 |
| JP | 2007-313461 | A | 12/2007 |
| JP | 2012-096235 | A | 5/2012 |

OTHER PUBLICATIONS

International Search Report for corresponding Application No. PCT/JP2014/050552, dated Apr. 28, 2014.
First Office Action issued in Chinese Patent Application No. 201480004777.3 dated Jun. 1, 2016.
Office Action issued in Chinese Patent Application No. 201480004777.3 dated Dec. 29, 2016.
Extended European Search Report issued in EP Patent Application No. 14740648.2 dated Aug. 5, 2016.

* cited by examiner

ELECTROSTATIC ATOMIZER

CROSS REFERENCE TO RELATED APPLICATIONS

This application is the National Phase of PCT/JP2014/050552, filed Jan. 15, 2014, which claims priority to Japanese Application No. 2013-004945, filed Jan. 15, 2013.

TECHNICAL FIELD

The present invention relates to an electrostatic atomizer that is excellent in atomization stability.

BACKGROUND ART

Conventionally, an atomizer which sprays a liquid in a container via a nozzle has been widely used in various fields. A known example of such an atomizer is an electrostatic atomizer which atomizes and sprays a liquid by Electro Hydrodynamics (EHD).

The electrostatic atomizer forms an electric field near a tip of a nozzle and uses the electric field to atomize and spray the liquid at the tip of the nozzle. Typically, the electrostatic atomizer is configured such that an electric field is formed between two electrodes (a pin and a capillary which correspond to the nozzle) by application of a voltage across the two electrodes (see, for example, Patent Literatures 1 and 2).

In carrying out desired atomization, it is important to control strength of an electric field formed near a tip of a nozzle. For example, in a case where the electric field is weak, atomization becomes unstable and the electrostatic atomizer itself is wetted due to spray-back (a phenomenon in which sprayed droplets come back to a device side). On the other hand, in a case where the electric field is stronger than necessary, multi-getting occurs.

A conventional electrostatic atomizer controls strength of an electric field formed near a tip of a nozzle, by directly adjusting a voltage to be applied across two electrodes. This method can be effectively used in a case where there is no factor, except a voltage, that influences the electric field. However, the method is ineffective in a case where there is a factor, in addition to a voltage, that influences the electric field.

As research advances, it is becoming clear that various factors, in addition to a voltage, influence the electric field. For example, it is becoming clear that a difference in design of each member constituting an electrostatic atomizer varies strength of an electric field formed near a tip of a nozzle. In such a case, it is necessary to directly compensate a voltage in consideration of an enormous number of parameters which vary in accordance with a design and the like of each member. However, it is difficult to detect all of the enormous number of parameters and directly compensate a voltage in accordance with values detected as the parameters.

CITATION LIST

Patent Literatures

Patent Literature 1

Japanese Translation of PCT International Publication Tokuhyo No. 2004-530552 (Publication Date: Oct. 7, 2004)

Patent Literature 2

Japanese Translation of PCT International Publication Tokuhyo No. 2006-521915 (Publication Date: Sep. 28, 2006)

SUMMARY OF INVENTION

Technical Problem

Under such circumstances, efforts have been made to develop, as a completely new method for controlling an electric field, a method for controlling strength of an electric field which is formed near a tip of a nozzle. In this method, for the purpose of controlling the strength of the electric field, while a current flowing through a pin, which is one of two electrodes, is controlled so as to have a prescribed value (in other words, while the current is kept at the prescribed value), a voltage is applied across the pin and a capillary based on a value of the current.

However, an electrostatic atomizer according to the above principle has a problem in that there is a start-up period in which an actual spray content is lower than a designed spray content, at the beginning of atomization.

The present invention is attained in view of the above conventional problems. An object of the present invention is to provide an electrostatic atomizer whose spray content is large even at the beginning of atomization.

Solution to Problem

In view of the above object, the inventors of the present invention made diligent studies and as a result, found that the occurrence of a start-up period in which period a spray content is lower can be prevented at the beginning of atomization by adjusting a tip shape of a second electrode. Thereby, the inventors have accomplished the present invention.

In order to solve the above problems, an electrostatic atomizer of the present invention includes: a first electrode for atomizing a substance; a second electrode; a current control section for controlling a value of a current flowing through the second electrode so that the value of the current may be within a prescribed range; and a voltage application section for applying a voltage across the first electrode and the second electrode, based on the value of the current controlled by the current control section, the second electrode having a tip whose shape has a curvature radius of 0.025 mm or more and 0.25 mm or less.

In the electrostatic atomizer of the present invention, a voltage is applied across the first electrode and the second electrode, so that an electric field is formed between the first electrode and the second electrode. At this point in time, the first electrode is positively charged and the second electrode is negatively charged (alternatively, the first electrode may be negatively charged, and the second electrode may be positively charged). This causes the first electrode to spray a positively charged droplet. The second electrode ionizes and negatively charges air in the vicinity of the second electrode. Then, the negatively charged air moves away from the second electrode, due to the electric field formed between the first electrode and the second electrode and a repulsive force among particles of the negatively charged air. This movement creates an air flow (hereinafter, this air flow may also be referred to as an ion stream), and the positively charged droplet is sprayed in a direction away from the electrostatic atomizer due to the ion stream.

In the above process, a conventional electrostatic atomizer cannot form a proper electric field between a first electrode and a second electrode because a tip of the second electrode has a sharply pointed shape. As a result, the conventional electrostatic atomizer has a start-up period in which a spray content is lower, at the beginning of atomization.

On the other hand, the electrostatic atomizer of the present invention has the second electrode whose tip has a shape that corresponds to at least a portion of a sphere with a curvature radius, so that the electric field is properly formed between the first electrode and the second electrode. As a result, the electrostatic atomizer of the present invention can prevent the occurrence of the start-up period.

Typically, the electric field formed near the second electrode becomes stronger as the tip of the second electrode becomes sharper. This allows the second electrode to efficiently generate ionized air.

The electrostatic atomizer of the present invention has the second electrode whose tip has a round shape. In view of a conventional technique, this seems to weaken the strength of the electric field formed near the second electrode and consequently, make it impossible to efficiently generate ionized air.

However, the electrostatic atomizer of the present invention can vary (e.g., increase) an output voltage so as to set a value of a current flowing through the second electrode at a prescribed value. Therefore, the electrostatic atomizer of the present invention can prevent the electric field formed near the second electrode from weakening and thereby can cause the second electrode to efficiently generate ionized air.

Advantageous Effects of Invention

The present invention yields an effect of preventing the occurrence of a start-up period in which a spray content is lower, at the beginning of atomization.

The present invention yields an effect of making it possible to stably atomizing a large amount of liquid for a long period.

The present invention yields an effect of making it possible to achieve atomization of a large amount of liquid with a simple device configuration and a simple operation.

Figure 4:
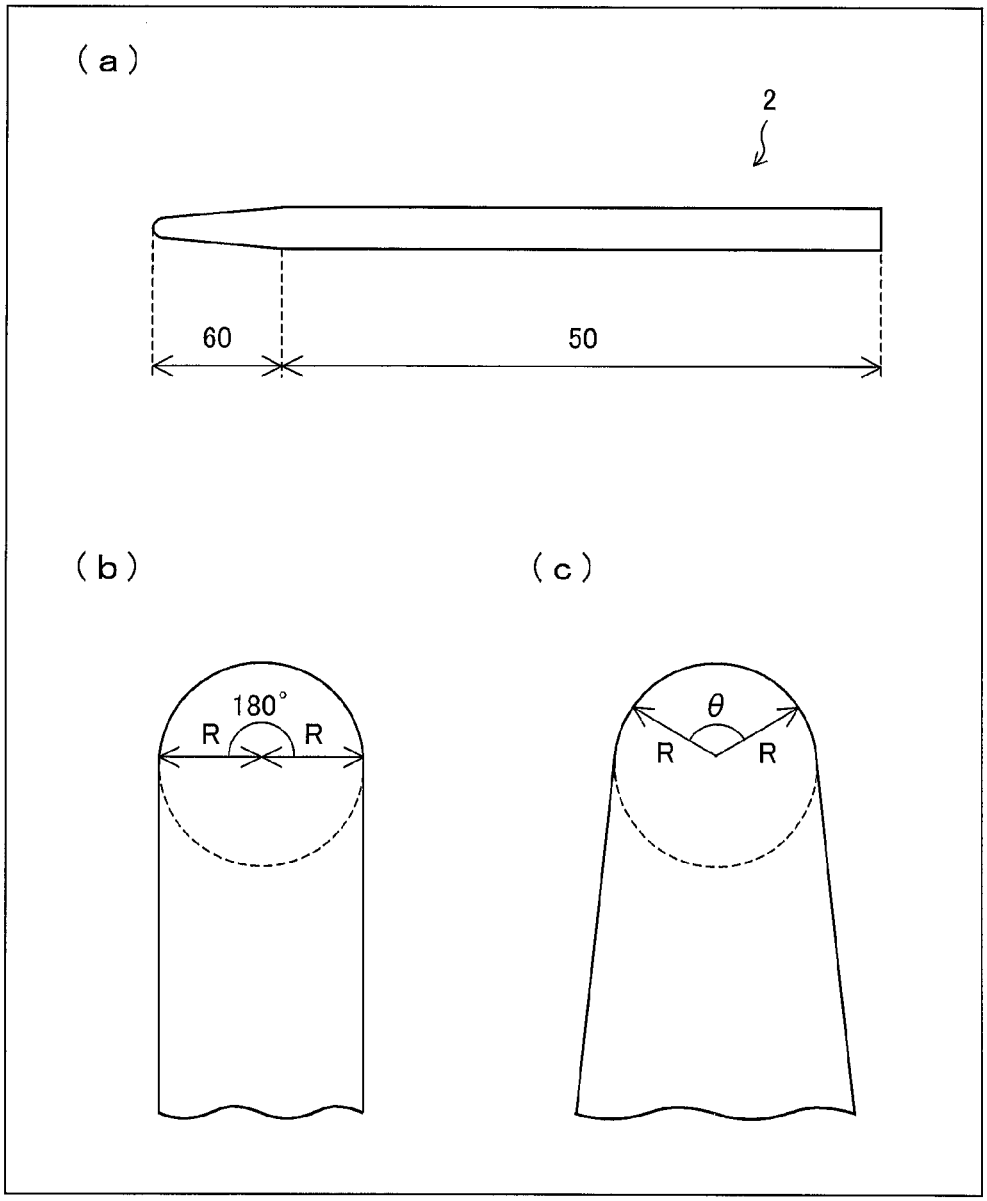

(a) through (c) of FIG. 4 are views each illustrating a configuration example of a reference electrode according to an embodiment of the present invention.

Figure 5:
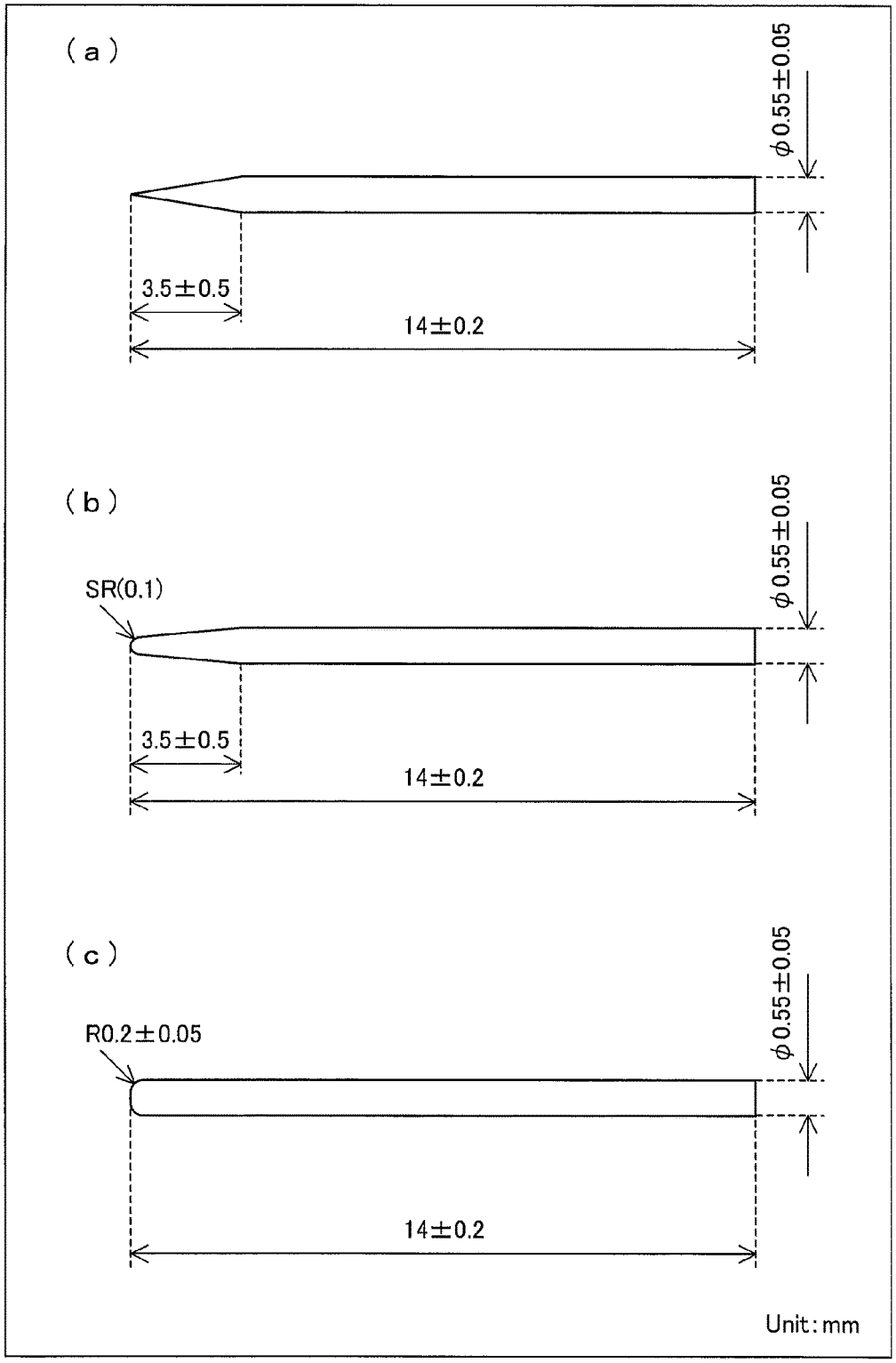

(a) through (c) of FIG. 5 are views each illustrating a configuration example of a reference electrode according to an example of the present invention.

Figure 6:
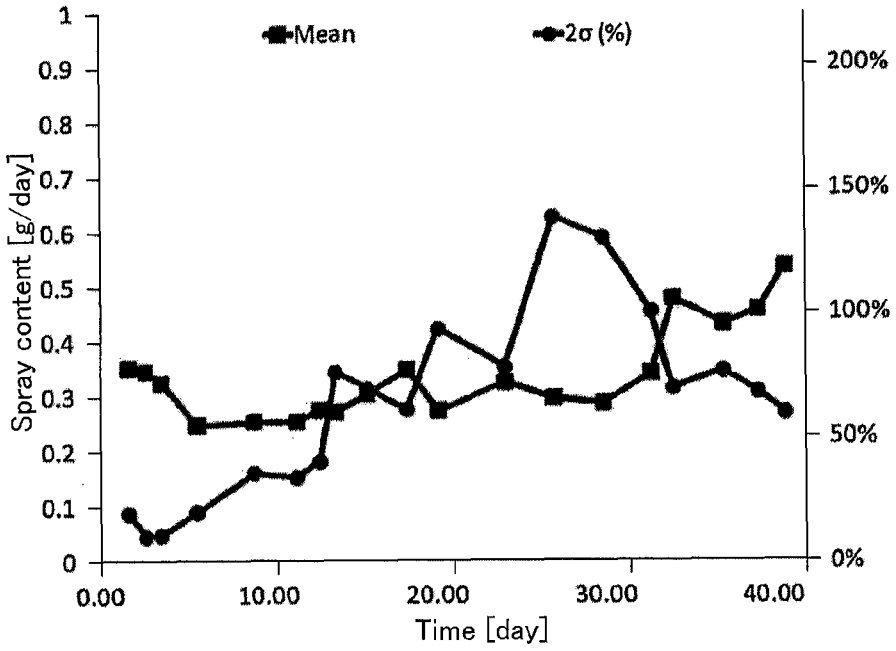

FIG. 6 is a graph showing resulting atomization characteristics of an electrostatic atomizer according to an example of the present invention.

Figure 7:
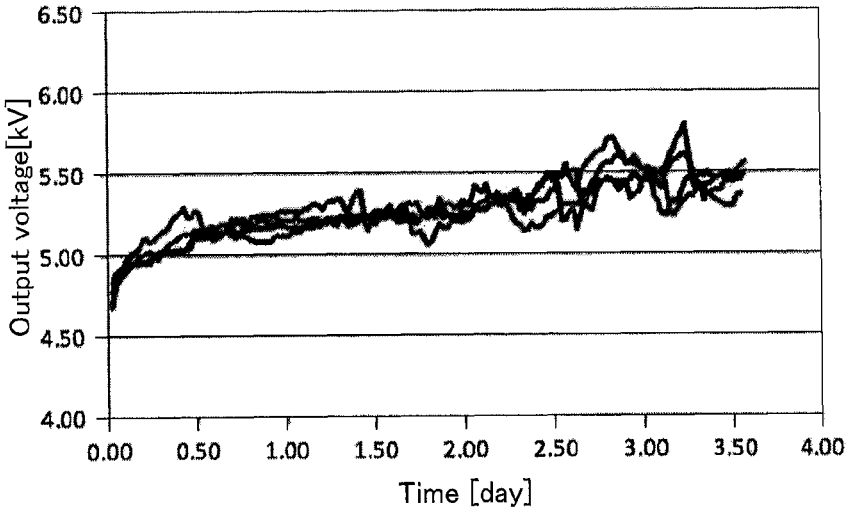

FIG. 7 is a graph showing resulting atomization characteristics of an electrostatic atomizer according to an example of the present invention.

Figure 8:
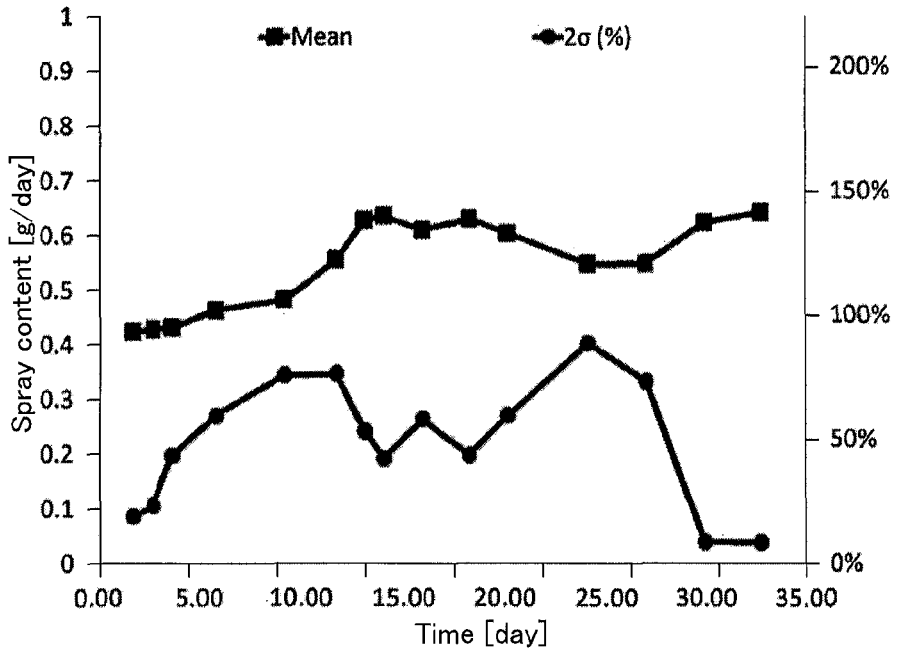

FIG. 8 is a graph showing resulting atomization characteristics of an electrostatic atomizer according to an example of the present invention.

Figure 9:
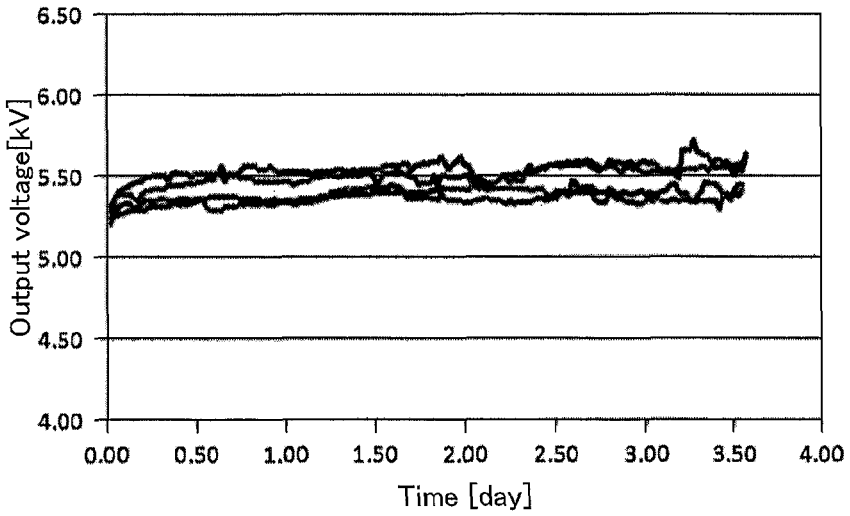

FIG. 9 is a graph showing resulting atomization characteristics of an electrostatic atomizer according to an example of the present invention.

Figure 10:
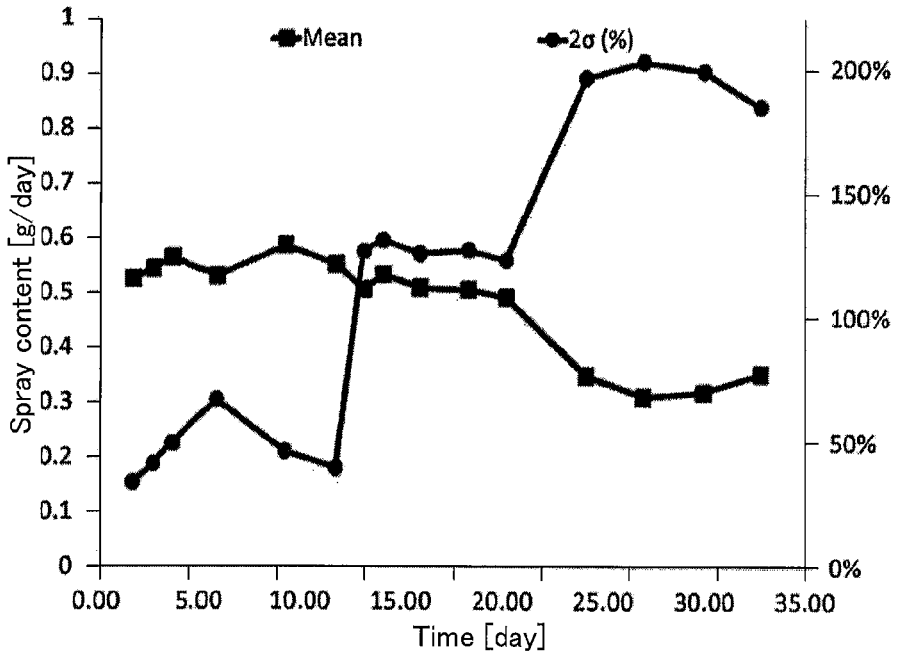

FIG. 10 is a graph showing resulting atomization characteristics of an electrostatic atomizer according to an example of the present invention.

Figure 11:
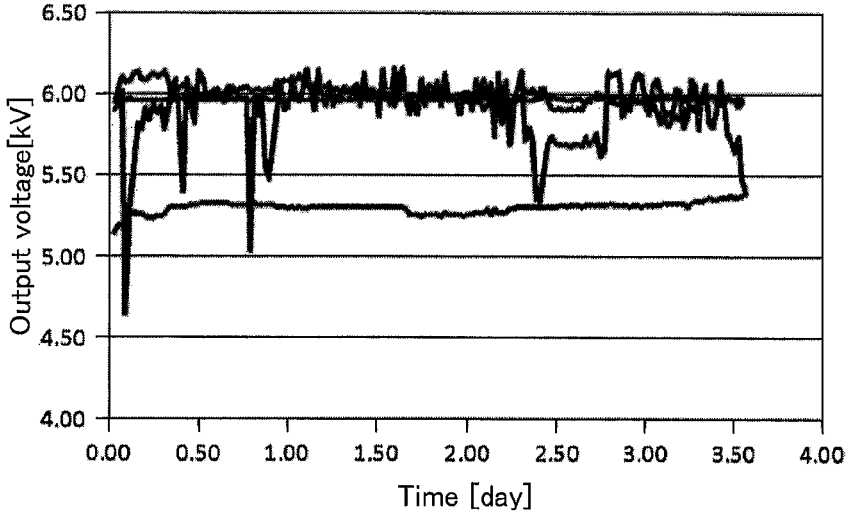

FIG. 11 is a graph showing resulting atomization characteristics of an electrostatic atomizer according to an example of the present invention.

Figure 12:
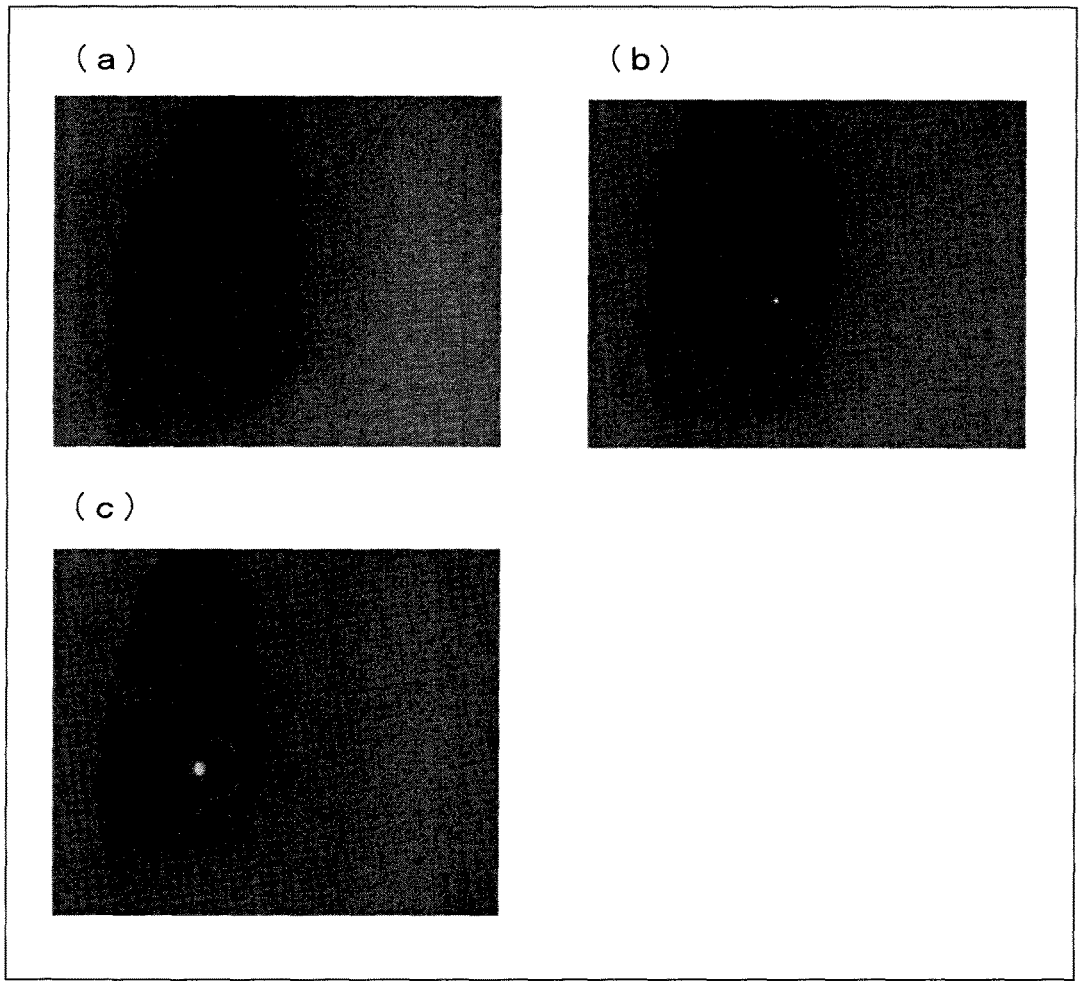

(a) through (c) of FIG. 12 are photographs showing resulting atomization characteristics of electrostatic atomizers according to examples of the present invention.

DESCRIPTION OF EMBODIMENTS

An electrostatic atomizer 100 or the like of the present embodiment is described below with reference to drawings. In the following description, identical members and components are given identical reference signs, respectively, and have identical names and identical functions. Thus, detailed descriptions of the members and components are not repeated.

[1. Configuration of Main Part of Electrostatic Atomizer 100]

Figure 1:
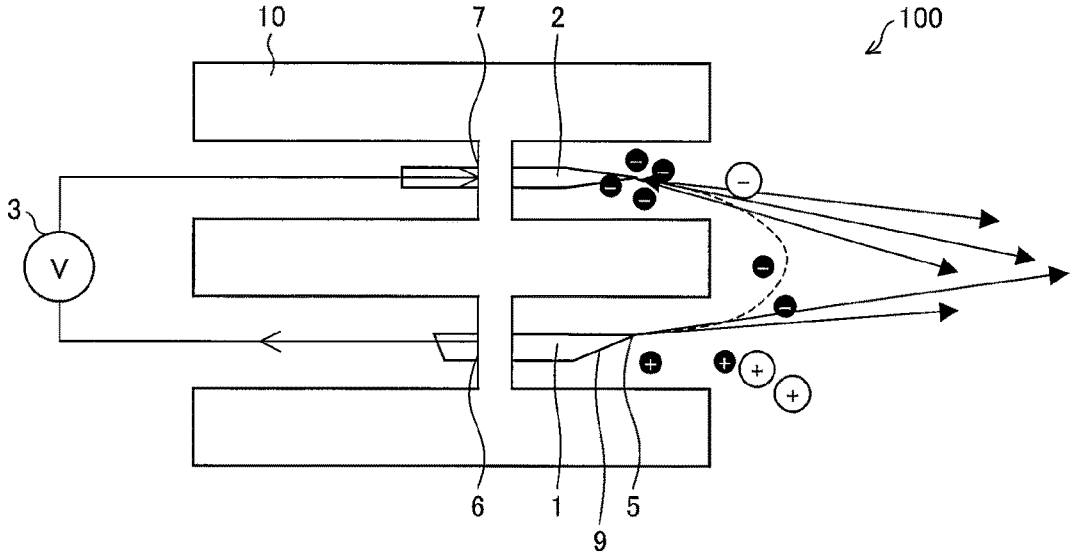
FIG. 1 is a view illustrating a configuration example of an electrostatic atomizer according to an embodiment of the present invention.

The following discusses a configuration of a main part of an electrostatic atomizer 100 with reference to FIG. 1.

The electrostatic atomizer 100 is used for, for example, atomization of aromatic oil, a chemical substance for an agricultural product, a medicine, an agricultural chemical, a pesticide, an air cleaning agent, and the like. The electrostatic atomizer 100 includes at least a spray electrode (a first electrode), a reference electrode 2 (a second electrode), a power supply device 3, and a dielectric 10. Alternatively, the electrostatic atomizer 100 of the present embodiment may be configured such that the power supply device 3 is provided outside the electrostatic atomizer 100 and the electrostatic atomizer 100 is connected with the power supply device 3.

The spray electrode 1 may include, for example, a conductive conduit such as a metallic capillary (e.g., type 304 stainless steel), and a tip. The spray electrode 1 is connected with the reference electrode 2 via the power supply device 3. An atomized substance is sprayed from a tip 5 of the spray electrode 1.

The spray electrode 1 can have an inclined plane that inclines with respect to an axial center of the spray electrode 1 and has a shape that becomes thinner and sharper toward the tip of the spray electrode 1. This arrangement makes it possible to define, by a tip shape of the spray electrode 1, a spray direction in which an atomized substance is to be sprayed.

As illustrated in FIG. 1, the spray electrode 1 is placed in a first space provided inside the dielectric 10. The tip of the spray electrode 1 can be placed on an open side of the first space. According to the configuration, a droplet which is to be sprayed from the spray electrode 1 can be released outward from an opening to outside the dielectric 10.

A shape and a size of the first space in which the spray electrode 1 is provided can be designed in accordance with various parameters (e.g., a voltage to be applied across the spray electrode 1 and the reference electrode 2, or a material of each constituent). For example, the first space may have a tubular shape, and a cross section of the tubular space may be identical or different in shape and size to/from the opening of the first space. Further, the opening may have, for example, a circular shape or an oval shape.

A specific configuration of the reference electrode 2 may be such that the reference electrode 2 is made up of, for example, a conductive rod such as a metal pin (e.g., type 304 steel pin). The spray electrode 1 and the reference electrode 2 are provided parallel with each other so as to be spaced apart from each other with a prescribed distance therebetween. The spray electrode 1 and the reference electrode 2 can be provided so as to be spaced apart from each other by a distance of, for example, 1 mm to 10 mm, 5 mm to 8 mm, or 8 mm. A specific configuration (e.g., a shape) of the reference electrode 2 is further discussed later.

As illustrated in FIG. 1, the reference electrode 2 is placed in a second space provided inside the dielectric 10, which space is different from the first space in which the spray electrode 1 is placed. A tip of the reference electrode 2 can be placed on an open side of the second space. According to the configuration, air having been ionized by the reference electrode 2 can be released outward from an opening to outside the dielectric 10.

A shape and a size of the second space in which the reference electrode 2 is provided can be designed in accordance with various parameters (e.g., a voltage to be applied across the spray electrode 1 and the reference electrode 2, or a material of each constituent). For example, the second space may have a tubular shape, and a cross section of the tubular space may be identical or different in shape and size to/from the opening of the second space. Further, the opening may have, for example, a circular shape or an oval shape.

The power supply device 3 is provided for application of a high voltage across the spray electrode 1 and the reference electrode 2. For example, the power supply device 3 can apply a voltage of 1 kV to 30 kV, 1 kV to 20 kV, 1 kV to 10 kV, or 3 kV to 7 kV across the spray electrode 1 and the reference electrode 2.

The power supply device 3 needs to apply a voltage across the spray electrode 1 and the reference electrode 2 based on a value of a current flowing through the reference electrode 2. Therefore, preferably, the power supply device 3 can apply a voltage in a wide range that is as wide as possible.

When a high voltage is applied across the spray electrode 1 and the reference electrode 2, an electric field is formed between the spray electrode 1 and the reference electrode 2. This causes an electric dipole inside the dielectric 10. At this point in time, the spray electrode 1 is positively charged, and the reference electrode 2 is negatively charged (alternatively, the spray electrode 1 may be negatively charged, and the reference electrode 2 may be positively charged). Then, a negative dipole occurs on a surface of the dielectric 10 which surface is closest to the positively-charged spray electrode 1, and a positive dipole occurs on a surface of the dielectric 10 which surface is closest to the negatively-charged reference electrode 2, so that a charged gas and a charged substance species are released by the spray electrode 1 and the reference electrode 2.

At this point in time, ionized air generated by the reference electrode 2 has an electrical charge having a polarity opposite to that of a substance to be atomized. Therefore, the electrical charge of the substance to be atomized is balanced by an electrical charge generated by the reference electrode 2. This allows the electrostatic atomizer 100 to perform a stable atomization by a current feedback control, based on the principle of charge equilibration. This will be described in detail later.

The dielectric 10 is made of a dielectric material such as nylon 6, nylon 11, nylon 12, nylon 66, polypropylene, or a polyacetyl-polytetrafluoroethylene mixture. The dielectric 10 may be configured to support the spray electrode 1 at a spray electrode mounting section 6 and to support the reference electrode 2 at a reference electrode mounting section 7.

Figure 2:
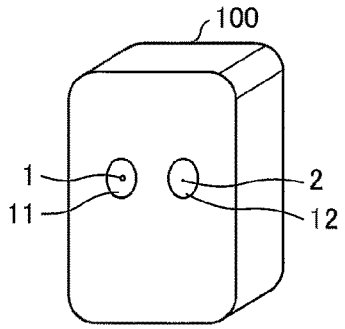
FIG. 2 is a view illustrating a configuration example of an electrostatic atomizer according to an embodiment of the present invention.

Next, the following discusses an appearance of the electrostatic atomizer 100 with reference to FIG. 2.

As illustrated in FIG. 2, the electrostatic atomizer 100 has a rectangular shape (or may be, of course, another shape). The spray electrode 1 and the reference electrode 2 are provided on one surface of the electrostatic atomizer 100. As illustrated in FIG. 2, the spray electrode 1 is provided in the vicinity of the reference electrode 2. Further, a circular opening 11 and a circular opening 12 are provided so as to surround the spray electrode 1 and the reference electrode 2, respectively.

As described above, the openings 11 and 12 are respectively connected to different spaces (the first and second spaces) provided inside the electrostatic atomizer 100. The spray electrode 1 is provided inside the opening 11 and the first space connected to the opening 11. Meanwhile, the reference electrode 2 is provided inside the opening 12 and the second space connected to the opening 12.

A voltage is applied across the spray electrode 1 and the reference electrode 2, so that an electric field is formed between the spray electrode 1 and the reference electrode 2. The spray electrode 1 sprays a positively charged droplet. The reference electrode 2 ionizes and negatively charges air in the vicinity of the reference electrode 2. Then, the negatively charged air moves away from the reference electrode 2, due to the electric field formed between the spray electrode 1 and the reference electrode 2 and a repulsive force among particles of the negatively charged air. This movement creates an air flow (hereinafter, the air flow may also be referred to as an ion stream), and the positively charged droplet is sprayed in a direction away from the electrostatic atomizer 100 due to the ion stream.

[2. Power Supply Device 3]

Figure 3:
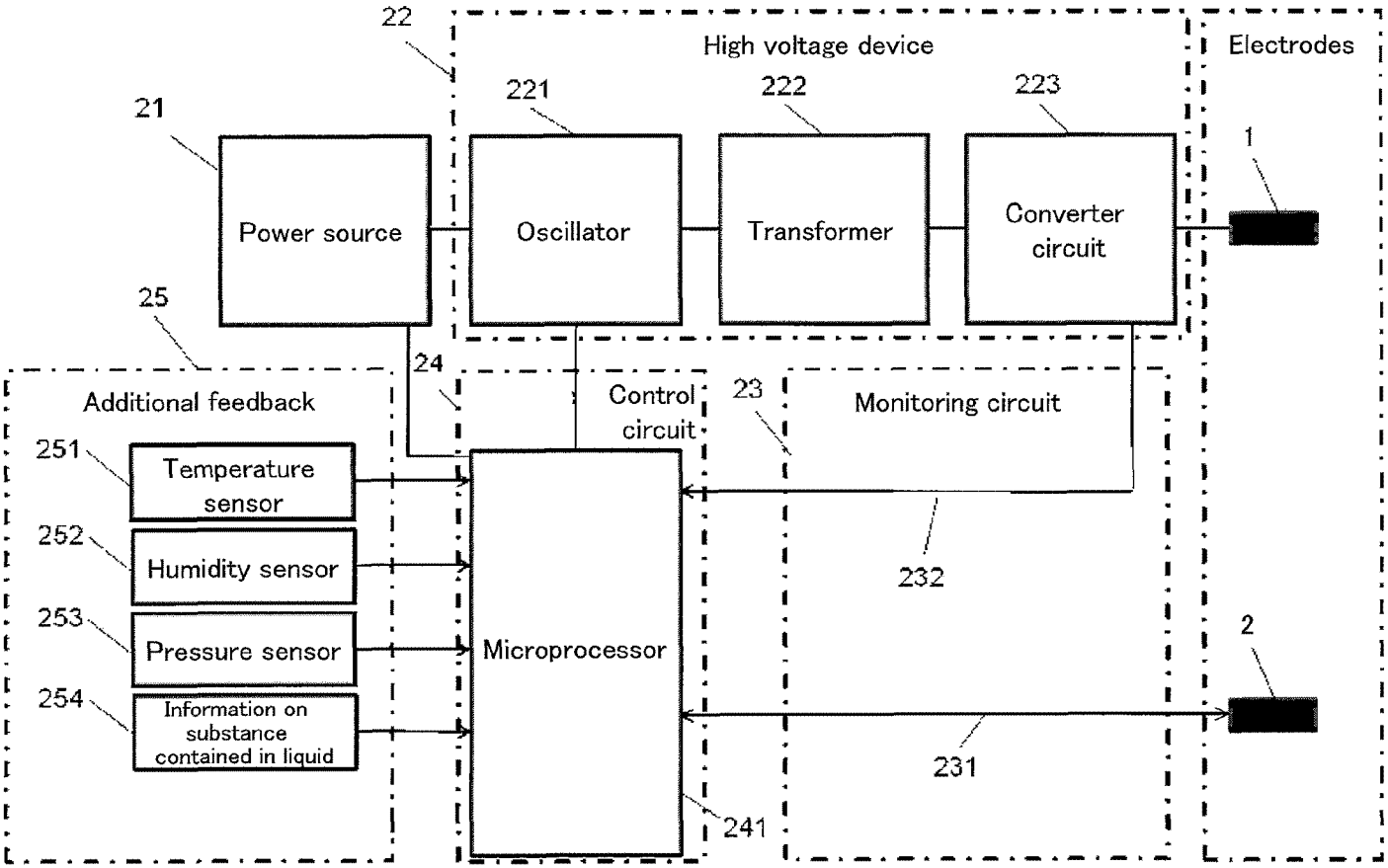
FIG. 3 is a diagram illustrating a configuration example of a power supply device according to an embodiment of the present invention.

FIG. 3 illustrates a configuration example of the power supply device 3. The power supply device 3 includes a power source 21, a high voltage generator (voltage application section) 22, a monitoring circuit 23 adapted to monitor output voltages of currents of the spray electrode 1 and the reference electrode 2, and a control circuit (current control section) 24 adapted to control the high voltage generator 22 such that an output voltage of the high voltage generator 22 has a desired value in a state in which a current value at the reference electrode 1 is controlled to be a prescribed value (within a prescribed range).

For many practical applications, the control circuit 24 may include a microprocessor 241. The microprocessor 241 may be adapted to enable further adjustment of output voltage and spray time based on other feedback information 25. The feedback information 25 includes environmental conditions (temperature, humidity, and/or atmospheric pressure), a liquid content, an optional user setting, and the like.

The power source 21 can be a well-known power source and can include a main power source or at least one battery. The power source 21 is preferably a low voltage supply, and a direct current (DC) power supply. For example, one or more voltaic cells may be combined to form a battery. A suitable battery includes one or more AA- or D-cell batteries. The number of batteries can be determined by a required voltage level and consumption power of the power source.

The high voltage generator 22 can include an oscillator 221 which converts DC to AC, a transformer 222 that drives by AC, and a converter circuit 223 connected to the transformer 222. The converter circuit 223 typically can include a charge pump and a rectifier circuit. The converter circuit 223 generates a desired voltage and converts AC back into DC. A typical converter circuit is a Cockcroft-Walton generator, but the present invention is not limited to the Cockcroft-Walton generator.

The monitoring circuit 23 includes a current feedback circuit 231, and may also include a voltage feedback circuit 232 depending on the application. The current feedback circuit 231 measures an electrical current at the reference electrode 2. Because the electrostatic atomizer 100 is charge balanced, measurement of the current of the reference electrode 2 and reference to thus measured current provide an accurate monitor of the current at the tip of the spray electrode 1. Such a method eliminates the necessities that (i) expensive, complex or disruptive measuring section is provided at the tip of the spray electrode 1 and (ii) the contribution of a discharge (corona) current to a measured current is estimated. The current feedback circuit 231 may include any conventional current measurement device, for example, a current transformer.

In a preferred embodiment, the current at the reference electrode 2 is measured by measuring a voltage across a set resistor (feedback resistor) which is series-connected with the reference electrode 2. In an embodiment, the voltage measured across the set resistor is read by using an analogue to digital (A/D) converter, which is typically part of the microprocessor. A suitable microprocessor with an A/D converter encompasses a microprocessor of the PIC16F18 family produced by Microchip. The digital information is processed by the microprocessor to provide an output for the control circuit 24**.

In a preferred embodiment, the voltage measured across the set resistor is compared with a prescribed constant reference voltage level by using a comparator. Comparators require only very low current input (typically nanoampere or lower) and make a fast response. The microprocessor 241 often provides in-built comparators for such purpose. For example, PIC16F1824 of the above mentioned microchip family provides a suitable comparator with very low current input and constant reference voltage. The reference voltage level to be inputted to the comparator is set by use of a D/A converter that is also included in the microprocessor 241. Here, selectable reference voltage levels are provided in advance. In typical operation, this circuit is able to detect whether the measured current is below or above a requested level that is determined by the magnitude of reference voltage and the feedback resistor, and to supply the information to the control circuit 24.

In applications where the knowledge of precise voltage value is required, the monitoring circuit 23 also includes the voltage feedback circuit 232, measuring the applied voltage to the spray electrode 1. Typically, the applied voltage is directly monitored by measuring the voltage at a junction of two resistors forming a potential divider connected between two electrodes. Alternatively, the applied voltage may be monitored by measuring a voltage developed at a node within the Cockcroft-Walton generator, by using the same potential divider principle. Similarly, as for current feedback, the feedback information may be processed either via an A/D converter or by comparing a feedback signal with a reference voltage level by using a comparator.

The control circuit 24 receives from the monitoring circuit 23 information indicative of a current value at the reference electrode 2, and then compares the current value at the reference electrode 2 with a prescribed current value (e.g., 0.867 μA). In a case where the current value at the reference electrode 2 does not match with the prescribed current value, the control circuit 24 controls the current value at the reference electrode 2 so that the current value is identical to the prescribed current value. The control circuit 24 further controls the output voltage of the high voltage generator 22 by controlling an amplitude, a frequency, or a duty cycle of the oscillator 221, or an on/off time of a voltage (or a combination of these), in addition to controlling the current value at the reference electrode 2 at the prescribed current value. Alternatively, in view of production errors on each unit of the power supply device 3, measurement errors of a current value, or the like, the control circuit 24 may control the current value at the reference electrode 2 so that the current value is within a certain "prescribed range" (e.g., 0.8 μA to 1.0 μA) instead of controlling the current value in a manner such that the current value is at the "prescribed value".

Other information (feedback information 25) can be provided to the microprocessor 241, for the necessity of voltage or duty cycle/spray period compensation based on ambient temperature, humidity, atmospheric pressure, liquid content of substance to be atomized, and the like. The information can be provided in form of analogue or digital information, and is processed by the microprocessor 241. The microprocessor 241 can provide compensation in order to provide better spray quality and higher stability by altering, based on the input information, the spray period, spray-on time, or applied voltage.

As an example, the power supply device 3 can include a temperature-sensing element such as a thermistor used for temperature compensation. In an embodiment, the power supply device 3 may be adapted to vary the spray period in accordance with variation in temperature sensed by the temperature-sensing element. The spray period is the sum of the on and off times of the power supply. For example, in a case of a periodical spray period, in which the power supply is turned on for a cyclical spray period of 35 seconds (during which time the power supply applies a high voltage across the first and second electrodes) and is turned off for 145 seconds (during which time the power supply does not apply high voltage as above), the spray period is 35+145=180 seconds.

The spray period can be varied by software built in the microprocessor 241 such that the spray period is increased from a set point as temperature increases and the spray period is decreased as temperature decreases from the set point. Preferably, the increase and the decrease in spray period are in accordance with a prescribed characteristic determined by properties of the substance to be atomized. Conveniently, compensatory variation of the spray period may be limited such that the spray period is only varied between 0 to 60° C. (e.g., 10 to 45° C.), thereby assuming that extreme temperatures registered by the temperature-sensing element are faults and are discounted whilst still providing an acceptable albeit non-optimized spray period for low and high temperature conditions. Alternatively, the on and off times of the spray period may be adjusted so as to keep the spray period constant, but to increase or decrease the spray time within the spray period as temperature decreases or increases.

The power supply device 3 can further include an inspection circuit for detecting a property of the substance to be atomized, and generating information indicative of the property of the substance to be atomized. The information, indicative of the property of the substance to be atomized, which has been generated by the inspection circuit is supplied to the control circuit 24. The control circuit 24 utilizes the information to compensate at least one voltage control signal. The voltage control signal is a signal generated according to a result obtained by detection of ambient environmental conditions (such as temperature, humidity, and/or atmospheric pressure, and/or spray content), and a signal for adjusting an output voltage or a spray period. The power supply device 3 may include a pressure sensor for monitoring ambient pressure (atmospheric pressure).

An internal configuration of the power supply device 3 has been discussed above. However, the above description is only an example of the power supply device 3. The power supply device 3 may be provided so as to have another configuration, provided that the power supply device 3 has the above described functions.

[3. Reference Electrode 2]

The reference electrode 2 of the present embodiment is one of two terminals across which a voltage is applied. The other one of the two terminals is the spray electrode 1. The reference electrode 2 has, for example, a needle shape (in other words, a long thin shape). Further, the reference electrode 2 has a tip whose shape has a curvature radius of larger than 0. In other words, the tip of the reference electrode 2 corresponds in shape to a portion of a sphere.

(a) of FIG. 4 shows a configuration example of the reference electrode 2 of the present embodiment. As illustrated in (a) of FIG. 4, the reference electrode 2 of the present embodiment may include a stem 50 whose cross section is substantially even in size, and a conical/pyramidal portion 60 whose cross section gradually decreases in size toward its tip. Further, the reference electrode 2 of the present embodiment may be made up solely of the conical/pyramidal portion 60 or the stem 50, though such a configuration is not illustrated. In (a) of FIG. 4, the stem 50 is longer than the conical/pyramidal portion 60. However, the stem 50 may be identical in length with the conical/pyramidal portion 60, or may be shorter than the conical/pyramidal portion 60.

In a case where the reference electrode 2 includes both the stem 50 and the conical/pyramidal portion 60 as illustrated in (a) of FIG. 4, for example, one end of the conical/pyramidal portion 60 (specifically, a thinner end that is not in contact with the stem 50) corresponds to the tip of the reference electrode 2.

Meanwhile, in a case where the reference electrode 2 is made up solely of the conical/pyramidal portion 60, for example, one end (specifically, thinner end) of the conical/pyramidal portion 60 corresponds to the tip of the reference electrode 2.

In a case where the reference electrode 2 is made up solely of the stem 50, for example, one end of the stem 50 corresponds to the tip of the reference electrode 2.

A specific shape of the stem 50 can be, for example, a pillar shape (e.g., a cylinder, a prism, or the like).

In a case where the stem 50 has a pillar shape, a size of an upper surface (e.g., a surface in contact with the conical/pyramidal portion 60) and a size of a lower surface (a surface opposite to the upper surface) are, for example, identical with or different from each other.

(a) Diameters of circles of the upper and lower surfaces of the stem 50 having a cylindrical shape, and (b) diameters of circumcircles of polygons of the upper and lower surfaces of the stem 50 having a prismatic shape may be, for example, 0.1 mm to 1.0 mm, 0.1 mm to 0.9 mm, 0.1 mm to 0.8 mm, 0.1 mm to 0.7 mm, 0.1 mm to 0.6 mm, 0.1 mm to 0.5 mm, 0.1 mm to 0.4 mm, 0.1 mm to 0.3 mm, or 0.1 mm to 0.2 mm.

In a case where the stem 50 has a pillar shape, a length of the stem 50 in a long axis direction (right-to-left direction of a sheet surface of (a) of FIG. 4) may be, for example, 1 to 100 times, 1 to 50 times, 1 to 20 times, 1 to 10 times, or 1 to 5 times as long as the diameters of the upper and lower surfaces of the stem 50.

A specific shape of the conical/pyramidal portion 60 may be, for example, a conical/pyramidal shape (e.g., a cone, a pyramid, or the like).

(a) A diameter of a circular base surface of the conical/pyramidal portion 60 having a conical shape and (b) a diameter of a circumcircle of a polygonal base surface of the conical/pyramidal portion 60 having a pyramidal shape may be set as appropriate in accordance with the shape of the stem 50. For example, the base surface of the conical/pyramidal portion 60 may have the same shape as the surface of the stem 50 with which surface the base surface of the conical/pyramidal portion 60 is in contact.

Specifically, (a) the diameter of the circle of the base surface of the conical/pyramidal portion 60 having a cylindrical shape, and (b) the diameter of the circumcircle of the polygonal base surface of the conical/pyramidal portion 60 having a pyramidal shape may be, for example, 0.1 mm to 1.0 mm, 0.1 mm to 0.9 mm, 0.1 mm to 0.8 mm, 0.1 mm to 0.7 mm, 0.1 mm to 0.6 mm, 0.1 mm to 0.5 mm, 0.1 mm to 0.4 mm, 0.1 mm to 0.3 mm, or 0.1 mm to 0.2 mm.

The tip of the reference electrode 2 of the present embodiment has a shape with a curvature radius R larger than 0. In other words, a surface of the tip of the reference electrode 2 of the present embodiment corresponds to at least a portion of a surface of a sphere. The following further discusses the shape of the tip of the reference electrode 2 with reference to (b) and (c) of FIG. 4.

(b) and (c) of FIG. 4 illustrate cross sectional shapes of the tips having different shapes, respectively. In other words, (b) and (c) of FIG. 4 illustrate shapes of cross sections of the tips having different shapes, respectively, each of which cross sections contains a center axis (a center axis extending in the right-to-left direction of the sheet surface of (a) of FIG. 4). Note that, in (b) and (c) of FIG. 4, the surface of the tip is indicated by a solid line.

In (b) of FIG. 4, the tip is provided with a region that corresponds to a half portion of a sphere having the curvature radius R. In (c) of FIG. 4, the tip is provided with a region that corresponds to a portion of the sphere having the curvature radius R.

A ratio of the portion (of the sphere) provided at the tip with respect to the sphere can be defined by a value θ indicated in each of (b) and (c) of FIG. 4. For example, the value θ illustrated in (c) of FIG. 4 may be $0° < \theta \leq 360°$, $0° < \theta \leq 270°$, $0° < \theta \leq 180°$, $0° < \theta \leq 120°$, or $0° < \theta \leq 60°$, but, of course, is not limited to these values. Though the minimum value is 0° in the above range, the minimum value may be 5°, 10°, 15°, 20°, 25°, 30°, 35°, 40°, or 45°.

The value θ is preferably $0° < \theta \leq 180°$, in view of more accurate control of strength of an electric field to be formed between the spray electrode 1 and the reference electrode 2 by a smoother tip of the reference electrode 2.

A length of the curvature radius R may be larger than 0 mm and 1.0 mm or smaller, larger than 0 mm and 0.5 mm or smaller, larger than 0 mm and 0.4 mm or smaller, larger than 0 mm and 0.3 mm or smaller, larger than 0 mm and 0.25 mm or smaller, larger than 0 mm and 0.2 mm or smaller, or larger than 0 mm and 0.1 mm or smaller.

More particularly, the curvature radius R is preferably 0.025 mm or larger and 0.25 mm or smaller, and more preferably, 0.075 mm or smaller and 0.2 mm or smaller.

In a case where the curvature radius R is 0.025 mm or larger and 0.25 mm or smaller, it is possible to more reliably prevent the occurrence of a start-up period. Furthermore, in a case where the curvature radius R is 0.075 mm or smaller and 0.2 mm or smaller, it is possible to prevent not only the occurrence of the start-up period but also the occurrence of spray-back.

A minimum value of the curvature radius R may be, for example, 0.1 mm or 0.15 mm. Accordingly, in the above described specific numerical ranges of the curvature radius R, the minimum value "0 mm" may be replaced with "0.025 mm", "0.075 mm", "0.1 mm", or "0.15 mm". The curvature radius R may be, for example, 0.1 mm or larger and 0.4 mm or smaller, 0.1 mm or larger and 0.2 mm or smaller, or 0.15 mm or larger and 0.3 mm or smaller. With this configuration, it is possible to prevent the occurrence of the start-up period and the spray-back in a well-balanced manner.

A specific material of the reference electrode 2 may be, for example, a conductive rod such as a metal pin (e.g., type 304 steel pin).

An electric conductivity of the reference electrode 2 may be, for example, $10^5$ S/m or higher and $10^8$ S/m or lower.

The electrostatic atomizer 100 of the present embodiment controls, with use of the control circuit (current controlling section) 24, a current flowing through the reference electrode 2 so that the current is within a prescribed range. In other words, in the electrostatic atomizer 100 of the present embodiment, the current flowing through the reference electrode 2 may be controlled to be at one value, to be any one of a plurality of values, or to be within a prescribed numerical range.

Specifically, the electrostatic atomizer 100 may control the value of the current flowing through the reference electrode 2 so that the value of the current is, for example, within a range from 0.1 μA to 1.0 μA, a range from 0.5 μA to 5.0 μA, or a range from 0.8 μA to 1.0 μA.

Furthermore, the electrostatic atomizer 100 may control the value of the current flowing through the reference electrode 2 so that the value of the current is one value or a plurality of values within the above described range. The value of the current flowing through the reference electrode 2 may be controlled to be, for example, 0.867 μA, but is not limited to 0.867 μA.

In the above description, the value of the current flowing through the reference electrode 2 is preferably controlled to be within a range of 0.867 μA±5%. This is because this range allows the electrostatic atomizer 100 to stably atomize a liquid.

Typically, the electric field formed near the reference electrode 2 becomes stronger as the tip of the reference electrode 2 becomes sharper. This allows the reference electrode 2 to efficiently generate ionized air.

The electrostatic atomizer 100 of the present embodiment has the reference electrode 2 whose tip has a round shape. In view of a conventional technique, this weakens the strength of the electric field formed near the reference electrode 2 and consequently, makes it impossible to efficiently generate ionized air.

However, the electrostatic atomizer 100 of the present embodiment varies (e.g., increases) an output voltage so as to set a value of a current flowing through the reference electrode 2 at a prescribed value. Therefore, the electrostatic atomizer 100 of the present embodiment can prevent the electric field formed near the reference electrode 2 from weakening and thereby can cause the reference electrode 2 to efficiently generate ionized air.

[4. Supplemental Matters]

The present invention may also be configured as below.

In an electrostatic atomizer according to one aspect of the present invention, the curvature radius is preferably 0.075 mm or more and 0.2 mm or less.

According to the configuration, it is possible to prevent the occurrence of a start-up period and the occurrence of spray-back.

In an electrostatic atomizer according to one aspect of the present invention, the current control section preferably controls the value of the current flowing through the second electrode so that the value of the current is within a range from 0.8 μA to 1.0 μA.

According to the configuration, it is possible to more reliably prevent the occurrence of the start-up period.

EXAMPLES

1. Studies on Atomization Characteristics of Electrostatic Atomizers—1

Three types of electrostatic atomizers A to C including three types of reference electrodes A to C, respectively, were prepared and atomization characteristics of each electrostatic atomizer were studied.

The following describes basic configurations of the electrostatic atomizers A to C. Note that the configurations of the electrostatic atomizers A to C are identical except that each of the electrostatic atomizers A to C includes a different reference electrode.

Atomized liquid droplet: a liquid droplet consisting of 10% of an aromatic compound, 79% of monomethylether, 8% of isoparaffin, and 3% of a sodium acetate solution;

Spray electrode 1: a spray electrode made of stainless steel and having an outer diameter of 0.4 mm and an inner diameter of 0.2 mm;

Dielectric 10: a dielectric made of polypropylene;

Opening 11: a circular opening having a diameter of 8 mm;

Opening 12: a circular opening having a diameter of 4 mm; and

Current caused to flow in the reference electrode 2: 0.867 μA (a) through (c) of FIG. 5 schematically illustrate three types of reference electrodes used in the present examples. Note that the reference electrode (hereinafter, referred to as "reference electrode A") illustrated in (a) of FIG. 5 has a sharp tip whose curvature radius is smaller than 0.025 mm (curvature radius is minimum). The reference electrode (hereinafter, referred to as "reference electrode B") illustrated in (b) of FIG. 5 has a tip whose curvature radius is 0.1 mm. The reference electrode (hereinafter, referred to as "reference electrode C") illustrated in (c) of FIG. 5 has a tip whose curvature radius is 0.2±0.05 mm.

FIGS. 6 and 7 show resulting atomization characteristics of the electrostatic atomizer A which was prepared with use of the reference electrode A. Specifically, FIG. 6 shows a relationship between time elapsed from the start of atomization and a spray content, and FIG. 7 shows a relationship between time elapsed from the start of atomization and an output voltage.

As illustrated in FIG. 6, the electrostatic atomizer A had a spray content of lower than 0.4 g/day until approximately 33 days from the start of atomization. That is, the electrostatic atomizer A had a start-up period of 33 days in which the spray content was lower.

As illustrated in FIG. 7, the electrostatic atomizer A had a low output voltage, and tended to increase in output current until approximately 4 days from the start of atomization. This indicates that until at least approximately days from the start of atomization, the electrostatic atomizer A had not only a lower spray content but also an unstable spray content.

FIGS. 8 and 9 show resulting atomization characteristics of the electrostatic atomizer B which was prepared with use of the reference electrode B. Specifically, FIG. 8 shows a relationship between time elapsed from the start of atomization and a spray content, and FIG. 9 indicates a relationship between time elapsed from the start of atomization and an output voltage.

As illustrated in FIG. 8, the electrostatic device B had a spray content of more than 0.4 g/day at the start of atomization. That is, the electrostatic device B had no start-up period in which the spray content was lower.

Further, as illustrated in FIG. 9, the electrostatic atomizer B had a higher output voltage and a more stable output voltage, as compared with the electrostatic atomizer A.

With use of a high output voltage, the electrostatic atomizer B could prevent the occurrence of the start-up period and achieved a stable atomization.

FIGS. 10 and 11 show resulting atomization characteristics of the electrostatic atomizer C which was prepared with use of the reference electrode C. Specifically, FIG. 10 shows a relationship between time elapsed from the start of atomization and a spray content, and FIG. 11 shows a relationship between time elapsed from the start of atomization and an output voltage.

As illustrated in FIG. 10, the electrostatic device C had a spray content of more than 0.4 g/day at the start of atomization. That is, the electrostatic device C had no start-up period in which the spray content was lower.

Although the electrostatic atomizer C tended to have an unstable spray content and to be wetted due to spray-back after approximately 15 days from the start of atomization, the electrostatic atomizer C could carry out a stable atomization and successfully prevented the occurrence of the spray-back at least for such a long term as 15 days.

As illustrated in FIG. 11, the electrostatic atomizer C was higher in output voltage than the electrostatic atomizer B, but the electrostatic atomizer C had an output voltage more unstable than that of the electrostatic atomizer B.

The output voltage of the electrostatic atomizer C reached a maximum voltage that the electric atomizer C could achieve (that is, the output voltage reached a limit of the device prepared). It is inferred that the electrostatic atomizer C could not accurately control a current value within a prescribed range because the voltage could not be accurately controlled. This therefore seems to have caused the electrostatic device C to have rather unstable output voltage and spray content.

2. Studies on Atomization Characteristics of Electrostatic Atomizers—2

In order to confirm atomization stability of the above electrostatic atomizers A to C, the presence/absence of spray-back was determined by visual inspection of surfaces of the electrostatic atomizers A to C.

(a) of FIG. 12 is a photograph of the surface of the electrostatic atomizer A, (b) of FIG. 12 is a photograph of the surface of the electrostatic atomizer B, and (c) of FIG. 12 is a photograph of the surface of the electrostatic atomizer C.

As shown in (a) to (c) of FIG. 12, droplets could be observed only on the surface of the electrostatic atomizer C. This clarified that spray-back had occurred in the electrostatic atomizer C.

The present invention is not limited to the embodiments described above, but may be altered by a skilled person in the art within the scope of the claims. An embodiment and an example derived from a proper combination of technical means disclosed in different embodiments and different examples are also encompassed in the technical scope of the present invention.

INDUSTRIAL APPLICABILITY

The present invention is applicable to an electrostatic atomizer that atomizes aromatic oil, a chemical substance for an agricultural product, a medicine, an agricultural chemical, a pesticide, an air cleaning agent, or the like.

REFERENCE SIGNS LIST

1 Spray Electrode (First Electrode)
2 Reference Electrode (Second Electrode)
3 Power Supply Device
6 Spray Electrode Mounting Section
7 Reference Electrode Mounting Section
10 Dielectric
11 Opening
12 Opening
21 Power Source
22 High Voltage Generator (Voltage Application Section)
23 Monitoring Circuit
24 Control Circuit (Current Control Section)
25 Feedback Information
39 Electric Conductor
50 Stem
60 Conical/pyramidal Portion
100 Electrostatic Atomizer
221 Oscillator
222 Transformer
223 Converter Circuit
231 Current Feedback Circuit
232 Voltage Feedback Circuit
241 Microprocessor

The invention claimed is:

1. An electrostatic atomizer comprising:

a spray electrode comprising a conductive conduit and a tip for atomizing a substance;

a reference electrode with a tip comprising a conductive rod being one of two electrodes across which a voltage is applied, the spray electrode being another one of the two electrodes;

a current control section for controlling a value of a current flowing through the reference electrode so that the value of the current is within a prescribed range; and a voltage application section for applying a voltage across the spray electrode and the reference electrode, based on the value of the current controlled by the current control section, the shape of the reference electrode tip consisting of a curvature radius of 0.025 mm or more and 0.25 mm or less, and wherein the spray electrode and the reference electrode are provided parallel with each other.

2. The electrostatic atomizer as set forth in claim 1, wherein the curvature radius is 0.075 mm or more and 0.2 mm or less.

3. The electrostatic atomizer as set forth in claim 1, wherein the current control section controls the value of the current flowing through the reference electrode so that the value of the current is within a range from 0.8 μA to 1.0 μA.

* * * * *